United States Patent [19]

Horan

[11] Patent Number: 4,864,663

[45] Date of Patent: Sep. 12, 1989

[54] INTEGRAL COSTUME MASK AND DISPLAY HEADGEAR

[75] Inventor: George A. Horan, Houston, Tex.

[73] Assignee: Original Expressions, Inc., Houston, Tex.

[21] Appl. No.: 154,962

[22] Filed: Apr. 6, 1988

[51] Int. Cl.[4] ..... A42B 1/20

[52] U.S. Cl. ..... 2/206; 2/200; 2/DIG. 11

[58] Field of Search ..... 2/206, 12, 171, 196, 2/209.1, 200, 175, 195, DIG. 11, 209.3

[56] References Cited

U.S. PATENT DOCUMENTS

| | | | |
|---|---|---|---|
| D. 277,996 | 3/1985 | Megargee | D2/250 |
| 2,964,757 | 12/1960 | Jarvis | 2/206 X |
| 2,988,743 | 10/1957 | Wagenfeld | 2/12 |
| 4,096,589 | 6/1978 | Goldstein | 2/12 |
| 4,246,659 | 1/1981 | Lyons | 2/175 |
| 4,335,471 | 6/1982 | Quigley, Jr. et al. | 2/12 |
| 4,747,164 | 5/1988 | Foulke | 2/12 X |

FOREIGN PATENT DOCUMENTS

| | | | |
|---|---|---|---|
| 0160103 | 12/1954 | Australia | 2/12 |

OTHER PUBLICATIONS

"Will He Turn Into Prince Charming", 07-22-85, p. 13, Sales Catalog.

*Primary Examiner*—Peter Nerbun

*Attorney, Agent, or Firm*—Banner, Birch, McKie & Beckett

[57] ABSTRACT

An integrally formed costume mask, display and headband formed of resilient but stiff material which yields to conform to various head sizes but which is stiff enough to maintain large display erect when worn. When not worn the headgear remains flat. The display portion is not limited to geometry of the headband portion, but may extend to all sides of headband.

12 Claims, 2 Drawing Sheets

INTEGRAL COSTUME MASK AND DISPLAY HEADGEAR

BACKGROUND OF THE INVENTION

The present invention relates to a "pop-up" or three-dimensional integral costume mask and display headgear.

There are many occasions upon which members of the public desire to wear high-quality but inexpensive decorative or novelty headwear. Such occasions typically include Mardi Gras celebrations, Halloween, sporting events, and athletic or charity events and the like. Owing to the peculiar nature of the market for such products, however, it is not feasible to offer such headwear in a variety of different sizes, and thus the design must be such that one size will truly fit all, from the smallest child's head to the largest adult's head. In addition, the requirements for the material are fairly stringent in that it must possess the degree of stiffness required to effectively present the display portion while simultaneously being resilient or yieldable enough to permit the head-encircling portion to accommodate the largest user. In addition, the material and design must work together cooperatively so as to resist stress at high-stress areas when the article is being worn.

One approach of the prior art is that presented by U.S. Pat. No. 4,246,659 to Lyons. Lyons teaches the selection of paperboard for the requisite degree of stiffness and attempts to overcome the lack of resiliency or expandability of such by punching out an opening for the head of the wearer in a manner so as to generally form a plurality of "fingers"surrounding the opening in the expectation that the size of the opening may be adjusted by deforming the fingers appropriately. However, as is well known, once such fingers are deformed for a certain size, such as for a parent's head, they may not be restored to satisfactorily accomodate a child's head. Further, such material rapidly loses its "springiness"once deformed, and thus the article may be worn only a very few times before it is no longer able to perform its intended function. In addition, while the "springiness" is maintained, the article is notoriously uncomfortable to wear.

An improved approach is that offered by U.S. Pat. No. 4,335,471 to Quigley, Jr. et al. The more pronounced disadvantageous features of Lyons, namely, limited wearability and discomfort, have been overcome by Quigley. Quigley employs a polyurethane foam material for the headband and display portion, but has no disclosure or suggestion for an integral mask. Indeed, the structure of Quigley is such that it cannot form a mask, but only a visor. As taught by Quigley, the display portion and the visor portion are essentially coplanar, and the structure is such that the natural restoring force of the deformed material tends to direct the visor portion up and away from the face to the position normally occupied by a visor. Thus the structure of Quigley is unsuitable for an integral mask-display headgear. Further, Quigley has no means for relieving stress at critical points, and thus may be expected to have a shorter useful lifespan.

These and other limitations and disadvantages of the prior art, and especially of the aforementioned patents, are overcome with the present invention, and commercially acceptable embodiments of an integral mask and display headgear and the like are herein provided.

OBJECTIVES OF THE INVENTION AND SUMMARY OF THE PREFERRED EMBODIMENT

It is therefore an object of the present invention to provide an integral mask and display headgear.

It is also an object to provide such an article capable of repeated wearings.

It is a further object to provide such an article with means for relieving stress at critical areas.

It is still a further object to provide such an integral article in which the size and shape of the display portion are not limited by the size and shape of the headring.

It is a still further object of the present invention to provide such an article in which the headring may comprise a portion of the display.

It is yet a further object to provide such an article with a rearward display portion.

The foregoing features and other features of the invention are realized in an illustrative embodiment of such an integral mask and display headgear. Briefly stated, this invention is directed to a long-wearing, comfortable article of headwear which may be stored, packaged, shipped and sold in a flattened or essentially two-dimensional condition. In contrast to the prior art, the size and shape of the primary display panel is not limited by the geometry of the headband portion, and thus a great many more designs may be displayed by the present invention, the number being virtually limitless and the variety being limited only by the imagination. In addition, if desired, the display may be continued beyond the front of the article to the sides and/or to the rear. Safety of small children wearing such integral costume masks while 'trick-or-treating' may be considerably enhanced by printing the article with highly reflective or fluorescent inks.

Accordingly, these and other features and advantages of the present invention will become apparent from the following detailed description, wherein reference is made to the figures in the accompanying drawings.

IN THE DRAWINGS

DESCRIPTION

Figure 1:
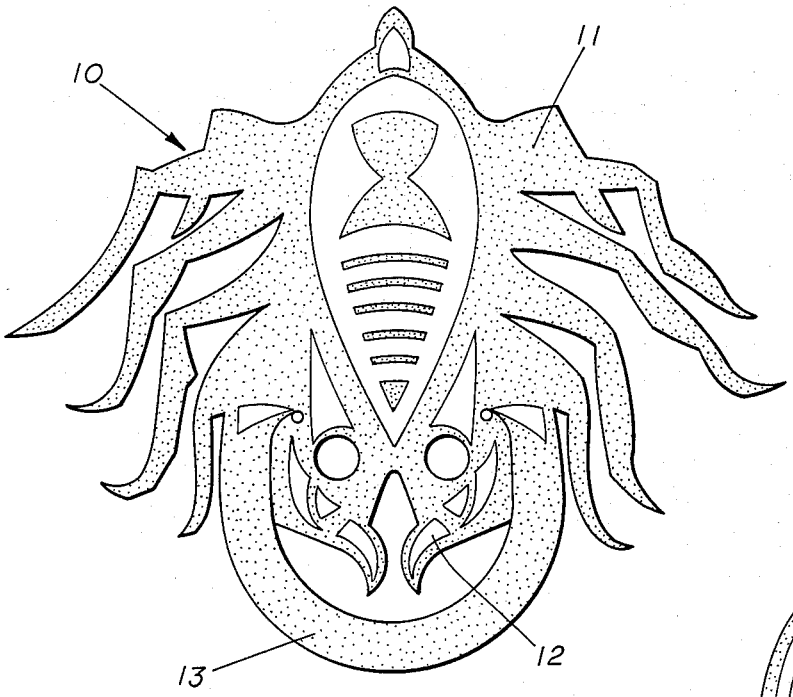
FIG. 1 is a top view of one embodiment of the invention in the flat or unworn condition.
Figure 2:
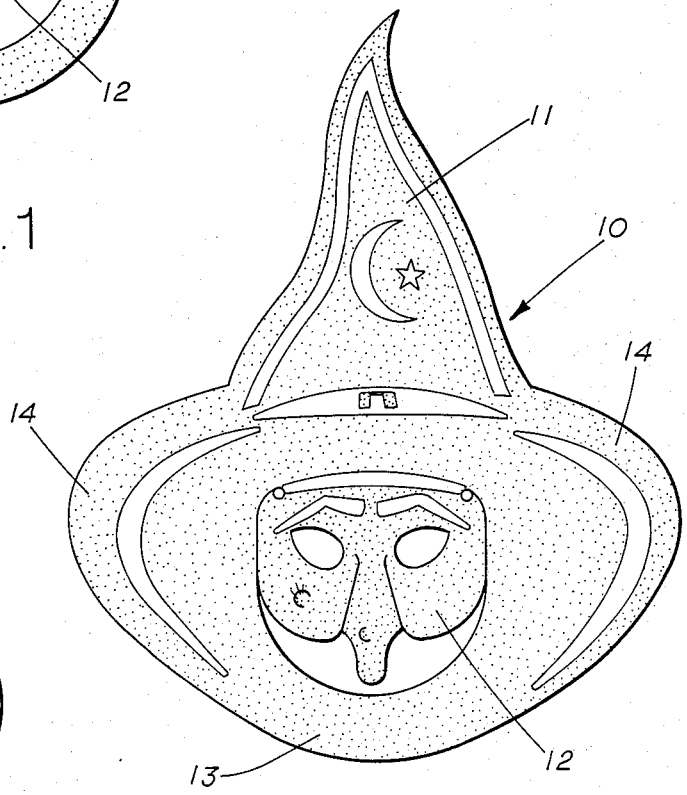
FIG. 2 is a top view of another embodiment of the invention in the flat or unworn condition.
Figure 3:
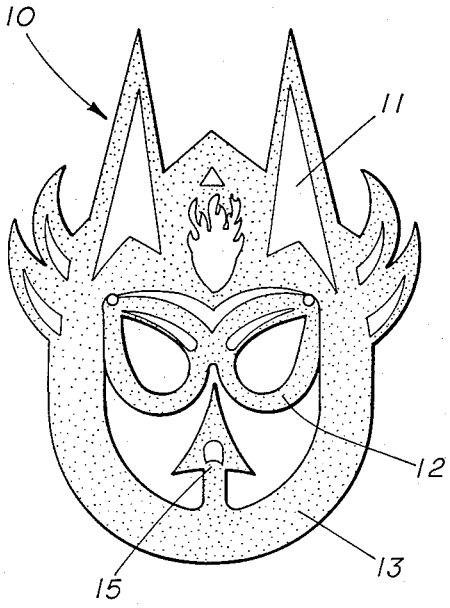
FIG. 3 is a top view of still another embodiment of the invention in the flat or unworn condition.

Referring now to the drawings in which like numerals denote similar elements and more particularly to FIGS. 1–3, preferred embodiments of headgear 10 in the unstressed condition are illustrated as comprising a first display portion 11, an integral mask portion 12, and a headband portion 13. The various articles of headgear may be conveniently manufactured by screen printing the desired pattern onto flat, uncut polyurethane foam sheets and then die cutting the same to the desired design. Printing prior to die cutting eliminates the need for precise placement of an irregularly-shaped object, and permits the overall process to be performed more quickly. The optimum combination of rigidity, flexibility and price has been found in polyurethane foam with density of about 1.2 pounds per cubic foot and an indentation load deflection value of about 40 pounds, cut from sheets of about 0.50 inch thickness. The indentation load deflection value is the amount of force required on a 51 in.$^2$ disk to produce a one-inch deflection in a block 15 inches square by 4 inches high. Other combinations of density and thickness will of course also perform satisfactorily, but higher density material or stiffer material will increase the cost accordingly and, for any given density, reduction in thickness below a critical thickness will not permit a large display to be maintained erect as desired.

Figure 7:
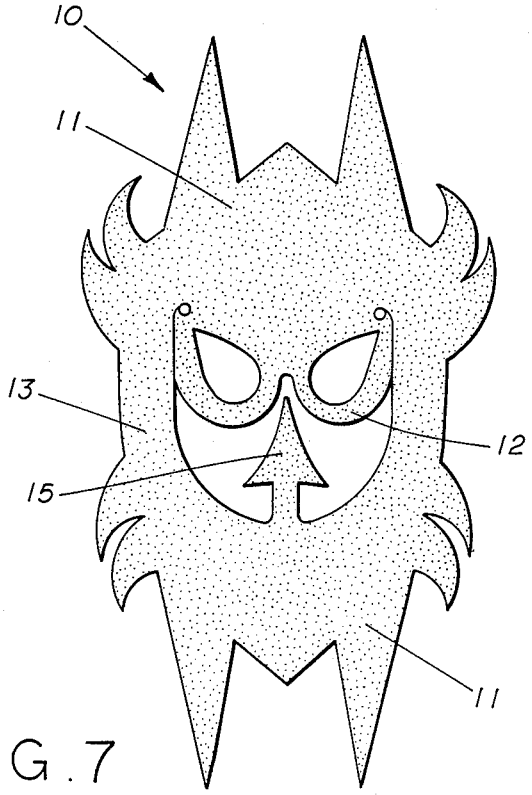
FIG. 7 illustrates an embodiment in the flat or unworn condition with a rearward display not limited by the geometry of the headband.

It may be noted that in the embodiment shown in FIG. 2, the headband portion 13 is considerably enlarged at the sides 14 such that side portions 14 constitute display portions themselves. It may also be noted that the embodiment of FIG. 3 comprises a rearward display portion 15. Should a rearward display portion larger than that permitted by the geometry of headband 13 be desired, headband portion 13 could be extended downwardly in whatever shape is desired. It could, for example, be formed as shown in FIG. 7 so as to duplicate front display portion 11, if desired, with or without additional display portion 15.

Figure 4:
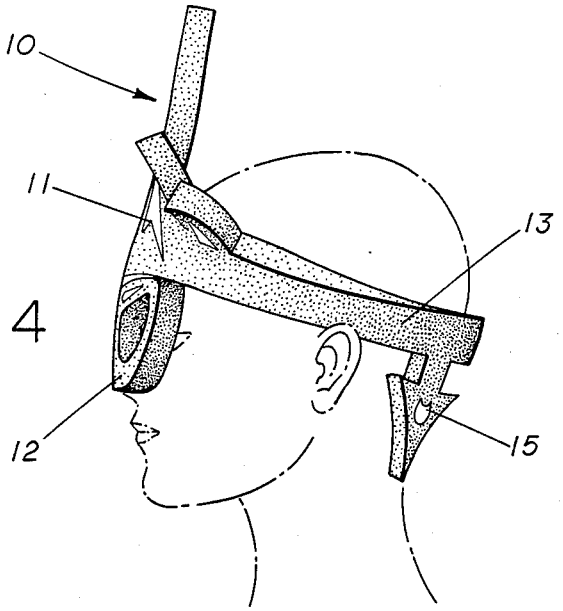
FIG. 4 illustrates a side view of the article of FIG. 3 while being worn (rearward display shown off-center for clarity).
Figure 5:
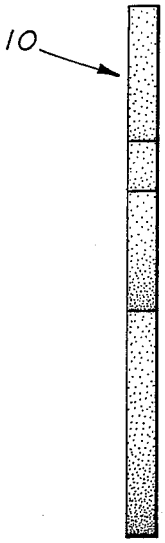
FIG. 5 illustrates a side view of the article of FIG. 3 when not worn.

FIG. 4 not only displays the preferred embodiment of FIG. 3 while being worn but also illustrates the preferred manner of wearing the article. That is to say that, preferably, the side portions of headband 13 are rotated outward by approximately ninety degrees as the article 10 is placed on the head of the wearer. Doing so will permit the printed portion of rearward display 15 to be oriented outward and thus visible to passers-by. It will also permit the printed portions of any side display, such as side display 14 of FIG. 2, to be visible. If the sides 13 are rotated inward instead of outward during placement of the article on the head, display portion 15 will be oriented upward instead of downward, and greater stress will be induced at the juncture of side portions 13 with integral mask 12 and display 11.

Figure 6:
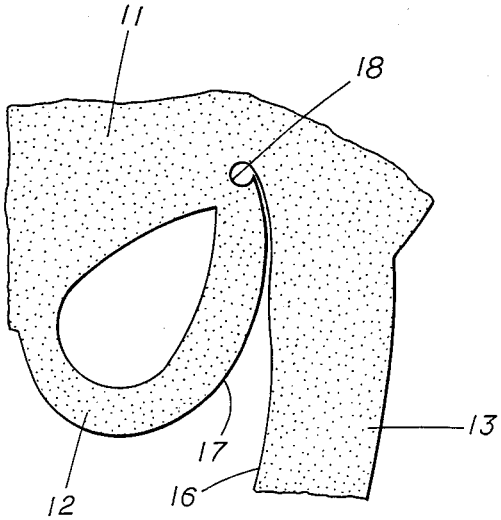
FIG. 6 illustrates an enlarged view of the stress-relieving portion of FIG. 3.

FIG. 6 is an enlarged view of one embodiment of the juncture of a side portion of headband 13 with the integral mask 12 and display 11. It may be seen that surfaces 16 and 17, the inner surface of headband 13 and the outer surface of mask 12, respectively, approach each other in close proximity and in parallel, as one moves upward along the portion of surface 16 shown in FIG. 6, but that such surfaces do not meet at a sharp point. Rather, surface 16 is continued in a curvilinear fashion to form intervening surface 18, which in this embodiment forms almost a complete circle intermediate surfaces 16 and 17 thereby forming a void adjacent thereto. Other forms of intervening surfaces or curvilinear cuts, such as ovals, ellipses, spirals, etc., will also satisfactorily relieve the stress, as will many non-curvilinear cuts such as octagonals, etc. The exact placement of the stress relieving cut may be varied as desired for aesthetic and other reasons, but it has generally been found preferable to locate the cut interior to the mask/display portion rather than the headband portion. So doing will maximize the amount of material left in the effective headband portion, thereby maximizing the strength of the same and its resistance to tearing forces. For some applications, it may be preferable to locate the intervening surface 18 even further away from headband portion 13, i.e., closer to an extension of the bridge of the nose of the wearer.

It will be apparent from the foregoing that many other variations and modifications may be made in the article hereinbefore described by those having experience in this technology without departing from the concept of the present invention. Accordingly, it should be clearly understood that the apparatus and methods depicted in the accompanying drawings and referred to in the foregoing description are illustrative only and are not intended as limitations on the scope of the invention.

What is claimed is:

1. Integral mask and display headgear comprising:

a resilient headband portion adapted to completely encircle a portion of the head of a wearer;

a first display portion formed integrally with and at least partially external to said headband portion;

a mask portion formed integrally with and at least partially internal to said headband portion, a portion of said headband portion being pivotable with respect to said integral display portion such that at least a portion of said display portion may remain essentially erect when said headgear is placed upon the head of a wearer; and means for relieving stress in the region of the juncture of said mask portion and said headband portion, wherein said stress-relieving means comprises a stress-relieving portion formed intermediate said mask portion and said headband portion, wherein said stress-relieving portion is formed as an essentially smooth curvilinear continuation of an inner surface of said headband portion and an outer surface of said mask portion, wherein said continuation forms a void adjacent thereto.

2. The headgear as claimed in claim 1, further comprising a second display portion formed integrally with and at least partially internal to said headband portion.

3. The headgear as claimed in claim 1, further comprising a second display portion formed integrally with and at least partially external to said headband portion.

4. The headband as claimed in claim 1, further comprising a second display portion formed integrally with at least one side of said headband portion.

5. The headband as claimed in claim 1, wherein said resilient headband portion comprises polyurethane foam.

6. The headband as claimed in claim 5, wherein said resilient headband portion is comprised of polyurethane foam of density less than 1.75 pounds per cubic foot.

7. The headband as claimed in claim 6, wherein said density is in the range of 0.65 to 1.75 pounds per cubic foot.

8. The headband as claimed in claim 7, wherein said density is in the range of 1.0 to 1.4 pounds per cubic foot.

9. The headband as claimed in claim 8, wherein said density is about 1.2 pounds per cubic foot.

10. The headband as claimed in claim 6, said polyurethane foam further comprising such foam with an indentation load deflection value in the range of 30 to 50 pounds.

11. The headband as claimed in claim 10, wherein said indentation load deflection value is in the range of 35 to 45 pounds.

12. The headband as claimed in claim 11, wherein said indentation load deflection value is about 40 pounds.

* * * * *